US005695587A

United States Patent [19]

Dumoux

[11] Patent Number: 5,695,587

[45] Date of Patent: Dec. 9, 1997

[54] METHOD OF COATING ARTICLES AND A TRANSFER FILM FOR COATING ARTICLES

[75] Inventor: Pierre Dumoux, Saint-Vallier, France

[73] Assignee: High-Tech Design, Saint-Vallier, France; a part interest

[21] Appl. No.: 596,619

[22] Filed: Feb. 5, 1996

[30] Foreign Application Priority Data

Oct. 2, 1995 [FR] France ..... 95 01562

[51] Int. Cl.[6] ..... B44C 1/165; B44C 1/175

[52] U.S. Cl. ..... 156/230; 156/239; 156/240

[58] Field of Search ..... 156/155, 230, 156/235, 236, 239, 240

[56] References Cited

U.S. PATENT DOCUMENTS

| | | | |
|---|---|---|---|
| 2,758,035 | 8/1956 | Matthes | 117/3.6 |
| 3,791,841 | 2/1974 | Carmellini et al. | 117/3.4 |
| 4,010,057 | 3/1977 | Nakanishi | 156/384 |
| 4,058,644 | 11/1977 | DeVries et al. | 428/200 |
| 4,175,151 | 11/1979 | Eppich et al. | 428/202 |
| 4,229,239 | 10/1980 | Arai et al. | 156/155 |
| 4,337,289 | 6/1982 | Reed et al. | 428/195 |
| 4,436,571 | 3/1984 | Nakanishi | 156/384 |
| 5,266,141 | 11/1993 | Seailles et al. | 156/230 |
| 5,418,041 | 5/1995 | Kent et al. | 428/195 |
| 5,608,426 | 3/1997 | Claveau | 156/234 |

FOREIGN PATENT DOCUMENTS 0424258 4/1991 European Pat. Off. .

*Primary Examiner*—Melvyn Andrews
*Assistant Examiner*—J. A. Lorengo
*Attorney, Agent, or Firm*—Griffin, Butler, Whisenhunt & Kurtossy

[57] ABSTRACT

The transfer film comprises at least one support film, a first layer in contact with the support film, and a second layer covering the finish layer, and the method consists in spreading the various layers successively on the support film and in immersing articles while the support film is deposited on a bath.

5 Claims, 1 Drawing Sheet

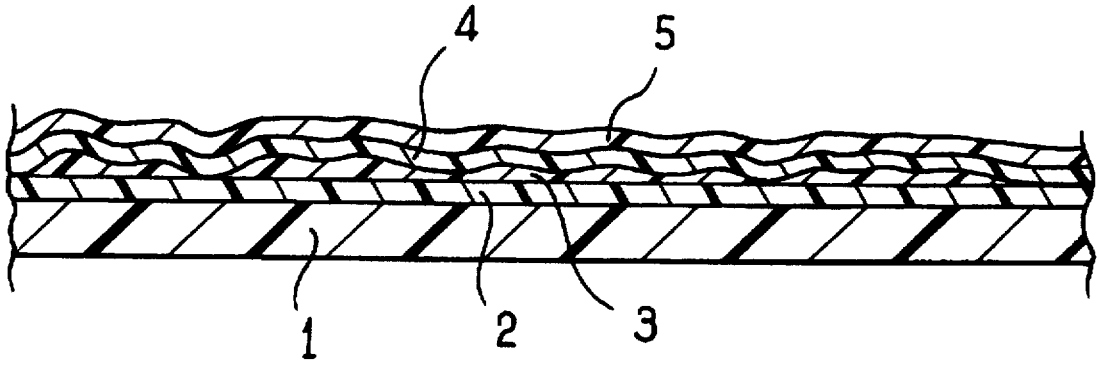
4
5
1
2
3

METHOD OF COATING ARTICLES AND A TRANSFER FILM FOR COATING ARTICLES

The present invention relates to a method of coating articles and to a transfer film for coating articles.

BACKGROUND OF THE INVENTION

A method and apparatus for decorating articles are known, in particular from document FR-A-2 281 833, consisting in printing a design on a transfer film such as a film of polyvinyl alcohol which is placed on a bath, the articles to be decorated then being immersed so as to press the film against the surface of the article, and thus transfer the design to the surface of the article.

That method is effective in decorating articles presenting a very wide variety of curvilinear surfaces. Nevertheless, given the diversity of materials used for making such articles, it often happens that the ink making up the design does not adhere in satisfactory manner on the material constituting the article, in which case it is necessary to provide a prior step of applying an undercoat to the article. In addition, the inks making up the design which is applied to the surface of an article are generally fragile, i.e. they are sensitive to shock, to abrasion, to the solvents used for cleaning the article, and to any other kind of external attack. In order to ensure that a design deposited on the article lasts for a long time, it is therefore necessary to cover the design in varnish.

At present, an article has an undercoat applied thereto and its decoration is protected with a varnish by spraying, followed by drying. Spraying and drying operations must be performed at stations that are different from that at which the article is immersed in the bath covered in transfer film, which means articles cannot be decorated on a continuous basis. In addition, spray techniques necessarily give rise to the loss of a large amount of sprayed material that does not reach the article. Not only does such loss of sprayed material constitute a financial loss, given the cost of the sprayed material, but it also constitutes pollution and therefore requires expensive installations to be implemented for the purpose of protecting the environment.

OBJECTS AND SUMMARY OF THE INVENTION

According to the invention, there is provided a method of coating articles with a coating comprising at least an outermost first layer and a second layer covered by the first layer, the method consisting in spreading each layer in succession on a support film that is softenable by the action of a liquid, and in immersing articles while the support film is deposited on a bath.

Thus, the various layers are applied on articles in a single operation which can be performed continuously, thereby achieving a considerable saving in time for putting the coating on the articles. In addition, the various layers making up the coating can be applied on the film while the film is disposed on a plane support so that loss of material is very small even when the material is applied by spraying.

The method of the invention can thus lead to considerable cost savings, concerning both running costs and investment, by eliminating the need for expensive painting, varnishing, or surface treatment installations.

In an advantageous version of the invention, the successive layers are projected onto the transfer film immediately upstream from the article immersion station. This achieves maximum adhesion between the layers and the lifetime of the decorative coating on articles is thus increased.

In another advantageous aspect of the invention, at least one of the layers is a continuous layer applied by means of a roller or using a curtain printing technique. This achieves minimum loss of finishing material.

The invention also provides a transfer film for coating articles, the film comprising at least one support film softenable by the action of a liquid, a first layer in contact with the support film, and a second layer covering the first layer, said second layer optionally being covered by a third layer itself covered in a layer of undercoat or of adhesion promoter.

In an advantageous version of this aspect of the invention, the first layer is a stable layer that is not reactivatable while the layer which is furthest from the support film is a stable layer that is reactivatable. Thus, while ensuring good adhesion between the coating and the article by reactivating the layer furthest from the support film prior to immersion of the articles, a coating is obtained on the articles that has a stable finish surface without there being any need to subject the coated article to stabilization treatment.

BRIEF DESCRIPTION OF THE DRAWING

Other characteristics and advantages of the invention appear on reading the following description of a particular and non-limiting embodiment of the invention described with reference to the sole accompanying FIGURE which is a section on a magnified scale through a transfer film of the invention.

MORE DETAILED DESCRIPTION

With reference to the FIGURE, the transfer film of the invention comprises a support film 1, a first layer 2, referred to below as the "finish" layer, in contact with the support film, a second layer 3 which is referred to below as the "decoration" layer in contact with the finish layer 2, a third layer 4 referred to as a "base" layer in contact with the decoration layer, and a fourth coat 5 referred to as the "undercoat" or "adhesion-promoting" layer in contact with the base layer 4. The support film 1 is made of any material suitable for being eliminated after the decorative coating has been deposited on an article, e.g. a polyvinyl alcohol or any other material that is softenable by the action of a liquid.

The finish layer 2 (first layers) is constituted by any material suitable for ensuring that the final coating can resist external attack of mechanical, chemical, . . . type, and also providing the desired appearance. By way of example, the finish layer may be a glossy or a mat varnish which is preferably applied to the support by low-pollution techniques such as printing by means of a roller or a curtain. When the finish layer is made of a curable material, curing is preferably performed immediately after the finish layer has been applied, thereby ensuring better conservation of the transfer film during storage. It is also possible to leave the finish layer in a non-cured state or to initialize curing partially only prior to transfer, and to finish off curing after the coating has been applied on the article to be decorated.

The decoration layer 3 (second layer) is obtained by applying a design to the finish layer 2. The design may be made by applying ink or any other material using known application techniques. When the finish layer 2 is curable, it is also possible to apply the decoration layer 3 before curing the finish layer 2, in which case the material constituting the finish layer can also serve as a binder for the material constituting the decoration layer 3, in particular when decoration is provided by solid inks applied in powder form. The decoration layer 3 may also be a layer of uniform color if the article is to be decorated specifically by being colored in uniform manner, or it may be a layer including additives or fillers for imparting a particular visual, tactile, or olfactive aspect to the decoration layer, which aspect may be changed after transfer by developing techniques, for example laser developing, . . . . For decoration including a pattern, it is possible to cancel or reduce deformation due to the shape of the article by prior complementary anamorphosis.

The base layer 4 (third layers) is useful when it is desired to provide a uniform background color that can be seen to a greater or lesser extent through a decoration layer 3 which is of non-uniform thickness, as shown in FIG. 2. The base layer 4 may be a paint applied by means of a spray gun or by any other applicator means such as passing between applicator rollers. When there is no risk of the decoration layer 3 migrating in the base layer 4, the base layer may be applied on the decoration layer 3 before it has dried so as to achieve better adhesion between the decoration layer and the base layer.

The undercoat layer (fourth layer) 5 is applied when the decoration layer 3 or the base layer 4 have insufficient adhesion on the material constituting the articles to be decorated, or when the material constituting the decoration layer 3 or the base layer 4 is a material that cannot be reactivated after drying.

The transfer film of the invention can be made in situ immediately prior to immersing the articles to be decorated. Under such circumstances, the various layers may be applied to the film upstream from the bath or when the film is placed on the top surface of a bath so as to cause the film to travel continuously past the means for applying the various layers. Drying strips using hot air or radiation can be interposed between the application means so as to cure the layers or to initialize curing thereof, and curing may continue while other layers are being applied, during transfer, or after transfer.

When the transfer film is to be stored, it is appropriate for at least the coating layer furthest from the support film 1, i.e. the undercoat layer 5 in the example shown, to be made of a material that is stable under storage conditions while nevertheless being reactivatable. A material is said to be "reactivatable" when its structure can be modified after storage so that the material again becomes suitable for sticking on the articles to be decorated.

Naturally the invention is not limited to the embodiment described and variants may be applied thereto without going beyond the ambit of the invention as defined by the claims.

In particular, although the transfer film of the invention is described above as having four layers superposed on the support film, it may naturally be made with some other number of layers as a function of the application envisaged. In this context, it may be observed that the transfer film of the invention may be used not only for decoration proper of articles, i.e. to apply a design on the surface of an article, but also to provide a covering of uniform color for the purpose of protecting the surface of the article in question or of masking flaws in the appearance of the article in question, e.g. when the article is made of a molded plastics material that does not have a uniform color.

The compositions of the various layers, in particular of the base layer 4 and of the decoration layer 3 may be of any kind, e.g. compositions including additives or fillers such as microcapsules enabling delayed differences to be developed after application on the support film. The corresponding development may be performed before or after transfer onto the object by using known techniques such as laser radiation, electron bombardment, thermal shock, . . . .

It is also possible to provide a layer of penetrating ink, i.e. a layer of ink which diffuses into the adjacent layer, e.g. by sublimation. This layer is deposited, for example, between the finish layer 2 and the decoration layer 3. After the multilayer coating has been transferred onto an article, the article is passed through an oven to enable the penetrating inks to act. In this context, it may be observed that the finish layer 2 can then act as the elastomer membrane or shell which is normally used to cover the substrate on which sublimable inks have been deposited, prior to raising the temperature. It is also possible to replace the finish layer with a layer suitable for being removed after or during the rise in temperature.

In a preferred embodiment of this aspect of the invention, the transfer film includes a first layer 2 (finish layer) having penetrating inks in a stable state, this first layer being reactivatable. The penetrating inks may also be integrated in a finish layer 2. When the transfer film is deposited on the bath, i.e. immediately upstream of the bath or while the film is already on the bath, a layer comprising an activator of penetrating inks and preferably an agent for promoting adhesion is deposited on the film. The penetrating inks are thus activated by the layer including the activator of penetrating inks so that the latter retains the penetrating inks inside the coating that is coated onto the article.

Before heating the article for causing the penetrating inks to diffuse it is possible to wash the article to eliminate support film residue.

To further improve the appearance of the resulting coating, it is also possible to wrap the article in an impermeable sheet, e.g. an aluminum sheet, before heating the article.

It is also possible to apply a non-cured or a partially cured layer on the article, which layer is cured at the same time as the decorative layer 3 after it has been transferred onto the article. Adhesion of the decorative layer is thus reinforced.

The multilayer technique of the invention may be used not only for decorating an article as described above, but also for modifying the physical or chemical characteristics of the surface of an article, e.g. by depositing an anti-misting coating, an anti-ultraviolet coating, an anti-abrasion coating, a coating that improves sliding.

In which case the first layer 2 (finish layer) may be an undercoat layer for subsequently receiving decoration, e.g. when decoration is performed a posteriori. It is also possible to leave gaps in one or more of the layers by disposing material that can be eliminated after transfer in gap zones on the film, which material may be eliminated, for example by being torn off or by being dissolved, so that the outside surface of the coated article includes such gaps.

In the invention, a material having poor adhesion characteristics and poor mechanical strength can be deposited on an article by being sandwiched between a finish layer and an undercoat layer.

With a continuous method, it is not necessary for the support film 1 to be in the solid state. On the contrary, it could be in the form of a gel deposited on the bath and receiving the successive layers prior to transferring them onto an article. It is also possible to use a support film that is intended to remain in place after transfer onto an article.

The apparatus for applying each of the layers is preferably controlled by a computer system associated with databases containing images, printing parameters, polysensory data, designs, and a digital image scanner, a device for synthesizing images and designs, and a display device for providing a three-dimensional display of the coated article with realistic rendition so as to enable certain print parameters to be readjusted prior to launching real printing. It should make it easy to implement intermediate sampling steps. The system could also be an expert system responding automatically as a function of results actually obtained. Furthermore, the designs database could be used interactively with users. It could receive various elements that vary with trends.

I claim:

1. A method of coating articles comprising the steps of:

at a station for immersing articles, depositing on a bath of liquid a transfer film comprising a support film that is softenable by the action of said liquid, said support film being covered on an upper face by successive layers of coating material including a first layer of curable material in a non-cured or partially-cured state in contact with said support film, and at least a second layer of coating material in contact with said first layer, putting at least one article in contact with said transfer film and immersing said at least one article in said bath of liquid for transferring said layers of coating material on said at least one article, and finishing off curing of said curable material after said coating has been applied on said at least one article.

2. A method of coating articles according to claim 1, wherein successive layers are applied on the support film immediately prior to immersing said at least one article.

3. A method of coating articles according to claim 1, wherein said first layer includes penetrating inks that are reactivatable, and wherein a layer that includes an activator for the penetrating inks is applied at the moment when said transfer film is deposited on the bath.

4. A method of coating articles according to claim 3, wherein the layer including the penetrating ink activator also includes an agent for promoting adhesion.

5. A transfer film comprising a support film that is softenable by the action of a liquid, said support film being covered on an upper face by successive layers of coating material including a first layer of curable material in a non-cured or partially-cured state in contact with said support film, and at least a second layer of coating material in contact with said first layer.

* * * * *